US005496004A

United States Patent [19]

Kuhn

[11] Patent Number: 5,496,004

[45] Date of Patent: Mar. 5, 1996

[54] DIRECT SUPPORT FROG ASSEMBLY

[75] Inventor: Stephen R. Kuhn, Richton Park, Ill.

[73] Assignee: ABC Rail Products Corporation, Chicago, Ill.

[21] Appl. No.: 516,504

[22] Filed: Aug. 17, 1995

Related U.S. Application Data

[63] Continuation-in-part of Ser. No. 217,698, Mar. 25, 1994.

[51] Int. Cl.[6] ..... E01B 7/00

[52] U.S. Cl. ..... 246/470; 246/472; 246/460; 246/463

[58] Field of Search ..... 246/427, 454, 246/458, 468, 469, 470, 471, 460, 463, 461, 472

[56] References Cited

U.S. PATENT DOCUMENTS

| | | | |
|---|---|---|---|
| 871,493 | 11/1907 | Einstein | 246/458 |
| 896,154 | 8/1908 | Reinoehl et al. | 246/458 |
| 900,422 | 10/1908 | Rabbe et al. | 246/458 |
| 1,032,577 | 7/1912 | Alden | 246/468 |
| 3,755,670 | 8/1973 | Dany | 246/458 |
| 4,081,162 | 3/1978 | Frank | 246/458 |

*Primary Examiner*—Mark T. Le
*Attorney, Agent, or Firm*—Thomas S. Baker, Jr.

[57] ABSTRACT

A direct support railbound frog having a frog casting clamped between a pair of wing rails and freestanding such that all wheel loads imposed on the frog casting primarily pass directly to the bottom surface of the casting without passing through the wing rails.

10 Claims, 3 Drawing Sheets

DIRECT SUPPORT FROG ASSEMBLY

CROSS-REFERENCES

This is a continuation-in-part of application Ser. No. 08/217,698, filed Mar. 25, 1994 and assigned to the assignee of this application.

FIELD OF THE INVENTION

This invention relates generally to railroad trackworks, and particularly concerns a railroad trackwork frog assembly which has an improved wheel impact load-bearing capability compared to known trackwork frog assemblies and results in substantially reduced wear and damage to the bases of wing rails incorporated in the assembly.

BACKGROUND OF THE INVENTION

A railroad frog is a device which is inserted at the intersection of a mainline rail and a turnout line rail to permit the flanges of wheels moving along one of the rails to pass across the other. The frog supports the wheels over the missing tread surface between the frog throat and the frog point and provides flangeways for aligning the wheels when passing over the point so that they will be afforded the maximum load bearing area. Generally, standard turnout frogs may be classified as rigid frogs which have no movable parts or movable wing frogs in which one or both of the wings move outward to provide flangeways for railroad car wheels. Rigid frogs include manganese railbound frogs, solid manganese frogs and self guarded frogs. Movable frogs include railbound manganese spring frogs.

Rigid railbound manganese frogs are constructed by combining carbon steel rails with manganese steel castings. These frogs are preferred over frogs which do not encompass manganese castings inasmuch as manganese steel has a resistance to abrasion and impact which exceeds that of carbon steel by as much as ten times.

In a conventional American Railroad Engineering Association (A.R.E.A.) standard railbound frog installation, a frog casting which may be manganese is clamped between a pair of wing rails. Laterally extending fit pads are formed on opposite sides of the frog casting to assist in positioning the casting with respect to the wing rails which support the casting. The fit pads are machined to complement the contour of the wing rail head and base fishing surfaces and the rail web which extends therebetween. Commonly, laterally extending bolts project through bores in the wing rails and the frog casting to secure the wing rails to the casting. This serves to locate the wing rails and the frog casting such that the required gauge lines are maintained. The bolted assembly further helps prevent longitudinal movement of the rails due to thermal expansion and contraction.

Manganese steel has a resistance to abrasion and impact which greatly exceeds that of carbon steel. In part, this is because of the metal's inherent ability to work harden. Although manganese steel's extreme resistance to abrasion makes it preferred for heavy rail traffic usage such as in frog areas, this same characteristic makes the metal extremely difficult to machine. The material does not conform to traditional guidelines for machining steel. Instead, manganese steel requires very low rates of feed and slow cutter speeds. Machine tool cutters must be configured to allow for very heavy cuts with high chip loads inasmuch as all material must be removed from each surface in a single tool pass due to the work hardening characteristics of the metal.

Cutter tool life is short even where the inserts are formed from special grades of carbide and ceramic materials. The conventional A.R.E.A. railbound manganese frog casting requires extensive machining of relatively complex shapes. The fit pads must be shaped to complement the webs and fishing surfaces of wing rails as stated above. Additionally, in a traditional frog the frog casting rests upon the angled fishing surface of the wing rail bases along the entire length of the interface between the casting and the wing rails this being the full length of the casting. This is illustrated in FIG. 3 of the drawings. Consequently, the entire bottom surface of the casting must be machined on both sides. This is time consuming and expensive.

Because the frog casting rests upon the fishing surfaces of the wing rail bases, loads borne by the tread surface of the casting are transmitted downwardly through the vertical side walls of the casting directly into the angular rail bases. This results in a grating action between the casting and the rail base mating surfaces due to the cyclic loading imposed therein by each passing rail car wheel. The grating action causes the surfaces to abrade which ultimately loosens the fit between the surfaces. Additionally, a portion of the vertical loads imposed upon the tread surface and side walls of the casting result in a lateral component of force being imposed upon the wing rail bases. This of course results because the load is not imposed at right angles to the base. The lateral force tends to bias the wing rails laterally outwardly from the casting. This loading tends to loosen the interface between the ring rails and the casting and imparts a tensile load to the bolts which clamp the casting between the wing rails. The cyclical tensile loading can result in failure of bolt assemblies and ultimate failure of the frog assembly.

Despite the inherent strength of manganese steel, higher train speeds and greater wheel loading which have become more prevalent in recent times have caused manganese frogs to exhibit evidence of failure after prolonged usage. Such failure has included crushed or collapsed tread areas believed to be symptomatic of shrinkage voids in the casting and spreading of the gauge lines both due to heavy wheel loads.

One type of frog casting which addressed these problems resulted in a railbound manganese frog having a "boxed-in" design commonly referred to as an "integral base" configuration. This structure has a bottom surface which sometimes is co-planar with the base surface of the wing rails and also has a continuous interface between the lower portion of the casting side wall and the upper angled or fishing surface of a wing rail flange. This interface extends the entire length of a casting. This design structure utilizes a longitudinally extending center wall or rib which extends between the underside of the upper running surface and the horizontal bottom wall. A significant degree of success was achieved with this design in terms of preventing crushing of the casting tread areas.

However, difficulties were encountered in the manufacture of the frog casting. It was found that the extensive use of sand cores in the drag portion of the mold which cores were required to produce the internal cavities resulted in chronic porosity of the casting. This porosity resulted from gases emanating from the breakdown of the organic binding agents utilized to harden the sand cores. Additionally, because of the large number of cores used in making the casting, problems frequently were encountered with non uniform cross-sectional thicknesses due to shifting of the cores in the drag portion of the mold.

While an integral base casting having a central longitudinally extending rib has substantially increased the life over that of a conventional manganese frog casting, it was desirable to develop a railbound manganese frog which would achieve greater casting life while reducing the complexity of the casting both in terms of internal passages and in terms of the amount of machining required to enable the casting to be fit to the wing rails.

The instant invention achieves this objective with a direct support railbound manganese frog having a frog casting which is clamped between mainline and turnout line wing rails but is freestanding such that substantially the entire bottom surface of the casting is spaced from the base of the wing rails and rests directly upon rail plates or other rail support structure. Consequently, the loads imposed on the casting by rail car wheels passing over the tread surfaces thereof are transferred directly into the frog supporting structure such as rail plates thus bypassing the wing rails themselves. This is accomplished by positioning the vertical side walls of the frog casting immediately below the load bearing surfaces and extending the walls downwardly to the base plate. To accomplish this, the inner base flange of each wing rail is cut away to provide clearance for the adjacent casting side wall. With this direct support frog design, abrasion between the frog casting and the wing rails is eliminated and no lateral loads are transmitted through the rail to the bolts which clamp the wing rails and frog casting together to form a railbound manganese bound assembly.

SUMMARY OF THE INVENTION

A fixed wing longitudinally extending railroad frog casting is adapted to be supported on a base plate and securely clamped between a pair of wing rails at the intersection of a mainline rail and a turnout line rail. The casting has a bottom support surface, a heel end, a heel extension adapted to be clamped between a pair of heel rails and a frog point integral with the heel. The frog point is defined in part by the bottom surface, a pair of diverging side surfaces and a top surface which defines a mainline running surface and a turnout line running surface for railroad car wheels. The casting also includes a toe end having a left hand wing and a right hand wing each defined in part by the bottom surface, an outer longitudinally extending perimeter side wall and a top wheel running surface. The left and right hand wings of the casting lie on opposite sides of and extend forwardly of the frog point and extend parallel to and are spaced laterally from one of the diverging side surfaces of the point to define a flangeway groove therebetween. A first wing rail has a base with a bottom surface and a pair of opposed inclined fishing surfaces connecting by a web to a head having a mainline wheel running top surface and a pair of opposed inclined fishing surfaces. A second wing rail has a base with a bottom surface and a pair of opposed inclined fishing surfaces connected by a web to a head having a turnout line wheel running top surface and a pair of opposed inclined fishing surfaces. The first wing rail has a first wing receiving section which complements and extends parallel to the perimeter side wall of the first wing and receives the first wing and a first guard rail section mounted on the base plate. The second wing rail has a second wing receiving section which complements and extends parallel to the perimeter side wall of the second wing and receives the second wing and a second guard rail section mounted on the base plate. The top wheel running surfaces of the first and second wings are parallel to the mainline and the turnout line wheel running surfaces of the wing rails and the bottoms of the first and second wings are parallel to the bottom surface of the first and second wing rails. The railroad frog casting is freestanding such that substantially the entire bottom surface of the casting is spaced from the base of each of the wing rails.

DESCRIPTION OF THE PREFERRED EMBODIMENT

The direct support railbound frog of the present invention incorporates a frog casting having a bottom surface spaced from the wing rails and adapted to rest directly on a rail plate. With this configuration wheel loads on the top surface of the casting are transferred directly into the supporting structure for the frog without passing through the wing rails. As a result, cyclic forces caused by wheel loads imposed on the casting are not transferred to flanges of wing rails and lateral forces are not imposed upon the bolts affixing the wing rails to the frog casting. Additionally, the vertical side walls of the frog casting are positioned immediately below the load bearing surfaces of the casting to provide better support for the cyclic loads imposed on the casting. This increases the strength of the casting and enables the casting structure to be simplified. Furthermore, because the frog casting is not supported on the wing rails, it does not have to be contoured to complement the rails and expensive machined surfaces on the fit pads and on the top and bottom of the casting are avoided.

Figure 1:
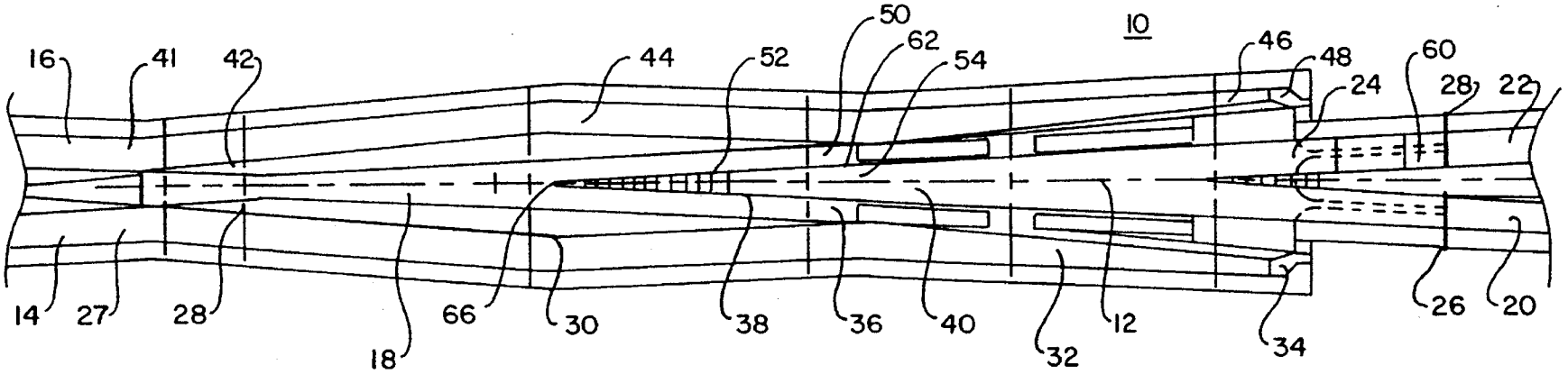
FIG. 1 is a plan view of a preferred embodiment of the rigid railbound direct support frog assembly of the instant invention.

Turning to the drawings, FIG. 1 depicts a direct support railbound manganese frog (10) of the present invention. Ordinarily, frogs are classified either as left-hand or as right-hand. The frog is considered left-hand when the turnout gauge line is on the left-hand side of the point and the mainline gauge line is on the right-hand side of the point as the point is viewed looking from the toe end toward the heel end of the frog. A frog would be considered right-hand if the turnout gauge line is on the right-hand side of the point and the mainline gauge line is on the left-hand side of the point as viewed from the toe end looking towards the heel end of the frog. The railbound frog (10) of the present invention will fit a left-hand or a right-hand frog application because it is symmetrical about a longitudinal centerline. However, for purposes of this description, frog (10) will be considered a right-hand frog.

Frog (10) has three main components. These components are a central longitudinally extending frog casting (12) which is bounded on opposite sides and clamped between a right-hand wing rail (14) and a left-hand wing rail (16). Preferably, frog casting (12) is constructed of manganese steel because of its strength and work hardening characteristics. However, the direct support features of the instant invention are not limited to a railbound frog in which the frog casting is manganese. The right-hand and left-hand wing rails (14 and 16) connect to mainline and turnout traffic rails, not shown, at the toe end (18) of frog (10). Right-hand and left-hand heel rails (20 and 22) are attached to the heel end (24) of frog (10). In the construction depicted in FIG. 1, right-hand and left-hand heel rails (20 and 22) are attached to frog casting (12) by flash butt welds (26 and 28). Alternatively, heel rails (20 and 22) may be affixed to the heel end (24) of casting (12) by bolt assemblies.

Right-hand wing rail (14) has a mainline running surface (27) designed to support the tread of a rail car wheel, not shown, a right-hand wing receiving section (30) which receives a wing of casting (12) which will be described in detail hereinbelow and a right-hand guard rail section (32) which terminates with a flared end (34). By making end (34) flared, a railroad car wheel traversing frog (10) in a trailing movement direction, i.e. from the heel end (24) toward the toe end (18) cannot strike the outer end of guard rail section (32). Guard rail section (32) functions to guard a railroad car wheel traveling in a flangeway (36) defined between a side surface (38) formed on one side of the frog point of frog casting (12) and guard rail section (32). The side surface (38) defines the gauge line for a wheel moving across a turnout line running surface (40) defined on frog casting (12) and described in greater detail hereinbelow.

Left-hand wing rail (16) has a turnout wheel running surface (41) which supports the tread of a wheel moving along the turnout rail, a wing receiving section (44) adapted to receive a wing of frog casting (12) and a guard rail section (46). Guard rail section (46) terminates with a flared end (48) and functions to guide a wheel which traverses a flangeway (50) defined between a side surface (52) formed on one side of the frog point of frog casting (12) and guard rail section (46). Side surface (52) defines the mainline gauge line for a wheel moving across a mainline running surface (54) on frog casting (12).

Figure 2:
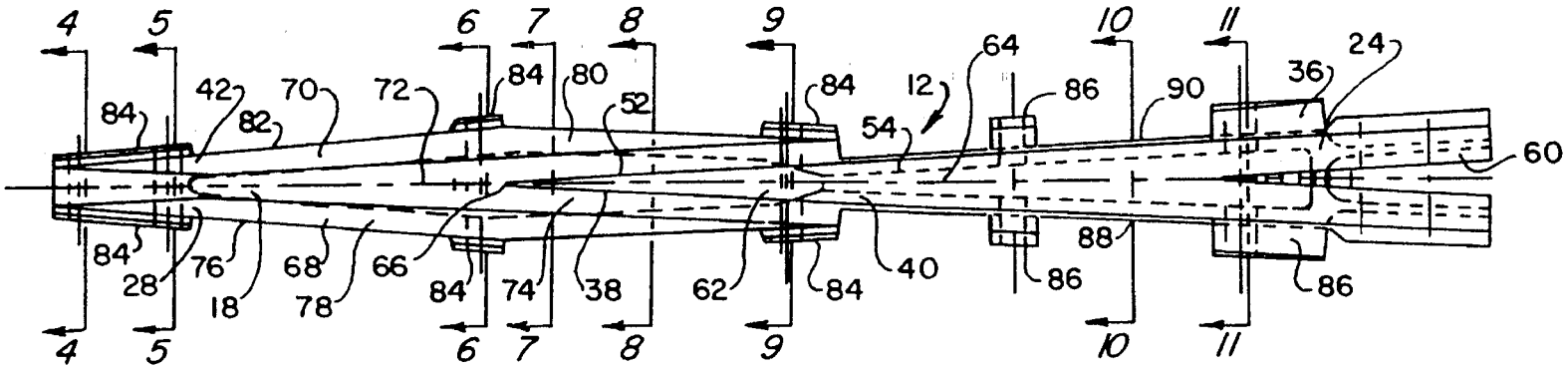
FIG. 2 is a plan view of the frog casting of the frog assembly of FIG. 1.
Figure 4:
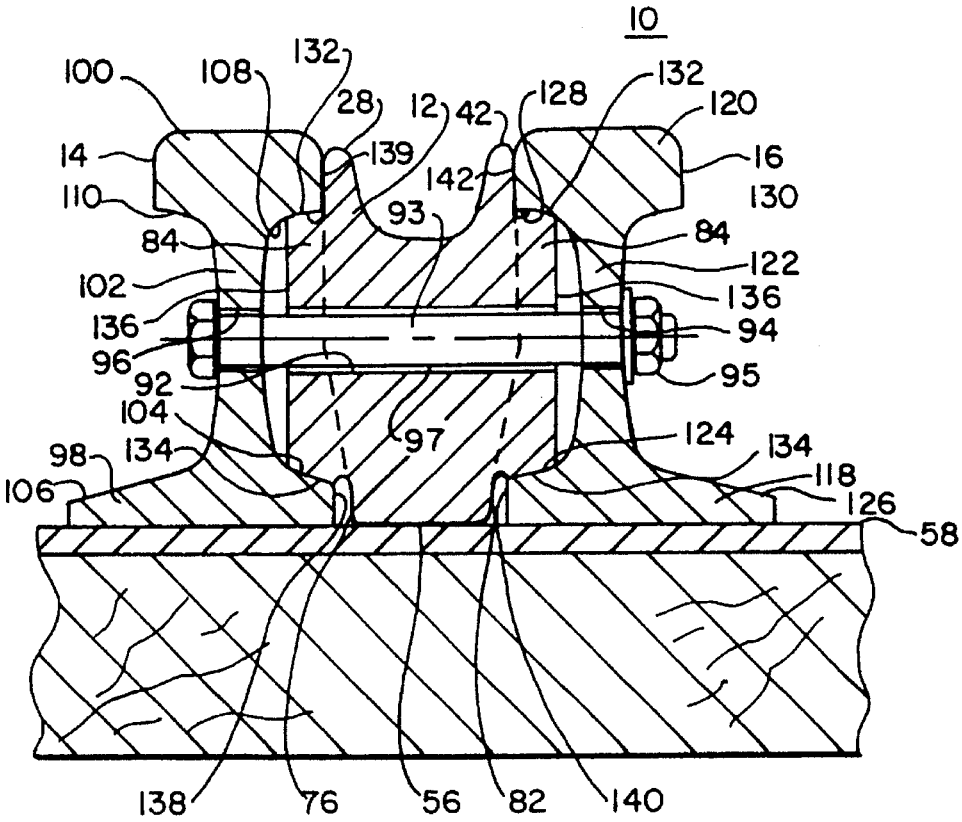
FIG. 4 is a view along line 4—4 of FIG. 2 at a fit pad position at the toe of the casting.

Details of frog casting (12) may be seen by referring to FIG. 2. FIGS. 4 through 11 illustrate various cross-sectional portions of casting (12) depicted in FIG. 2 combined with right-hand and left-hand wing rails (14 and 16). Frog casting (12) has a bottom surface (56) adapted to rest directly upon a rail plate (58) or other rail support surface as depicted in FIG. 4. Casting (12) has a heel extension (60) which projects from the heel end (24) thereof and attaches to a pair of heel rails (20 and 22) as described hereinbefore. Casting (12) incorporates a frog point (62) integral with said heel end (24) defined in part by said bottom surface (56), the diverging side surfaces (38 and 52) and a top surface (64) which defines turnout running surface (40) and mainline running surface (54). Surface (64) terminates at the frog point (62) at the toe end (18) of casting (12).

The tip (66) of frog point (62) is positioned between right-hand and left-hand wings (68 and 70) near frog throat (72). The wings (68 and 70) provide transition surfaces for railroad car wheels moving between the turnout and mainline running surfaces (40 and 54) formed on the top surface (64) of frog point (62) and the mainline and turnout wing running surfaces (28 and 42).

Right-hand wing (68) is spaced from the side surface (38) of frog point (62) by flangeway groove (36) and is defined in part by the bottom surface (56) of frog casting (12), an outer longitudinally extending perimeter side wall (76) and the top wheel running surface (28). A portion of left-hand wing (70) extends parallel to the side surface (52) of frog point (62) and is spaced laterally from the surface by flangeway groove (50). Left-hand wing (70) is defined in part by the bottom surface (56) of frog casting (12), an outer longitudinally extending perimeter side wall (82) and the top wheel running surface (42).

Referring again to FIG. 2 it may be observed that a plurality of laterally extending positioning pads (84) are attached to the outer longitudinally extending perimeter side walls (76 and 82) of right-hand and left-hand wings (68 and 70) respectfully at the toe end (18) of frog casting (12). Positioning pads (86) also project laterally from the side walls (88 and 90) at the heel end (24) of frog casting (12). Positioning pads (84 and 86) laterally position frog casting (12) with respect to right-hand and left-hand wing rails (14 and 16) when the rails are Joined to the casting to form the direct support railbound frog (10) of the instant invention.

Turning to FIG. 4, it may be observed that at least one lateral bore (92) is formed in frog casting (12) in the area of each positioning pads (84 and 86). In other words, the lateral bores (92) pass through the positioning pads (84 and 86). These pads are spaced apart approximately twenty to twenty-four inches. Each of the bores (92) is aligned with similar bores (94 and 96) formed in the adjacent wing rails (14 and 16). Bolt (93) is inserted into the aligned bores (92–96) to clamp frog casting (12) between wing rails (14 and 16) to form the direct support railbound frog (10). A nut (95) threads onto bolt (93) to complete the bolt assembly. It may be seen that the outside diameter (97) of bolt (93) is somewhat smaller than the diameter of the lateral bores (92) in the positioning pads (84 and 86). This allows limited vertical movement of frog casting (12) relative to wing rails (14 and 16) to ensure that the casting (12) is supported on the rail plate ((58) and that any wheel loads imposed on the casting (12) are not transferred to the bolts (93).

Right-hand wing rail (14) has a base (98) and a head (100) which are joined by a vertical web (102). Base (98) has a pair of opposed angled top or fishing surfaces (104 and 106) which project from opposite sides of web (102). A pair of opposed angled fishing surfaces (108 and 110) also are formed on the bottom of rail head (100). Similarly, left-hand wing rail (16) has a base (118) joined to a head (120) by a vertical web (122). Base (118) has a pair of angled or top or fishing surfaces (124 and 126) and head (120) has a pair of lower angled fishing surfaces (128 and 130). Referring again to FIG. 4, it may be observed that each of the positioning pads (84) has a pair of narrow top angled surfaces (132) and a bottom angled surfaces (134) which complement the fishing surfaces (108 and 128) formed on the heads (100 and 120) of wing rails (14 and 16) and the fishing surfaces (104 and 124) formed on the bases (98 and 118) of these rails. Bottom angled surfaces (134) are approximately four inches in length and one half inch or less in width. This small surface area ensures that minimal (less than two percent) of any load imposed up the casting (12) in the area of the positioning pads (84 and 86) is imparted to the rail bases.

It should be noted that the narrow angled surfaces (132 and 134) of the positioning pads (84) serve only to laterally position frog casting (12) with respect to the wing rails (14 and 16). It also should be noted that the outer side walls (136) of the positioning pads (84 and 86) are spaced from the webs (102 and 122) of the wing rails (14 and 16). It is not necessary that the outer side walls (136) be shaped to complement and engage these webs because the positioning pads are not serving to support the frog casting (12) on the rails (14 and 16) as has been done in the past. The casting is supported by having base (56) engage the top surface of rail plate (58). Thus, the weight of the frog casting (12) and the railroad car wheel loads imposed on the casting are transmitted directly to the rail plate (58) without passing through the wing rails (14 and 16).

Referring again to FIG. 4, it may be seen that the side walls (76 and 82) of the frog casting (112) are aligned with the top running surfaces (28 an 42). The side walls (76 and 82) extends substantially vertically downwardly and intersect the bottom surface (56) of frog casting (12). In other words the side walls (76 and 82) are substantially aligned with the wheel running surfaces (28 and 42). This is made possible because the bases (98 and 118) of the right and left-hand wing rails are cut adjacent the bottom support surface (56) of the frog casting (12). It may be seen that the base of wing rail (14) is cut to form a side wall (138) which is substantially aligned with the inner vertical side wall (139) of the head (100) of that rail. Similarly, the base (118) of left-hand wing rail (16) is cut such that a side wall (140) is substantially aligned with the inner vertical side wall (142) of the head (120) of that rail. Although the direct support frog (10) of this invention requires that the bases of the wing rails (14 and 16) be cut to accommodate the expanded base surface (56), machining of the frog casting (12) is substantially reduced with this design.

Figure 3:
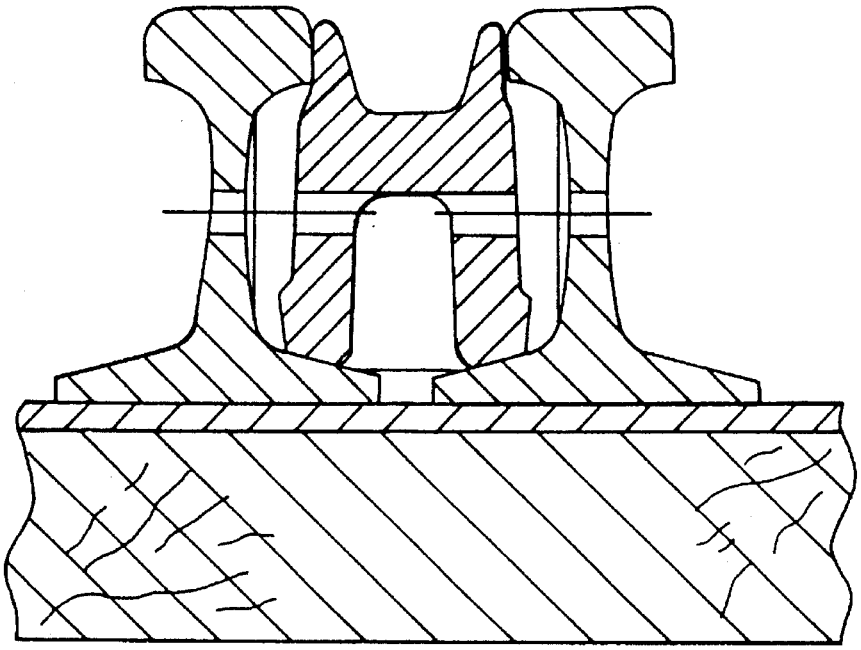
FIG. 3 PRIOR ART
FIG. 3 is a cross-sectional view of a prior art railbound frog assembly taken at a fit pad position and showing a frog casting supported on the bases of a pair of wing rails.

Turning to FIG. 3, a prior art railbound manganese frog may be seen in contrast to the direct support frog of this invention. It should be noted that in the prior art frog, a pair of wing rails wrap around the body of the frog casting. Fit pads extend from opposite sides of the casting and are machined to complement the fishing surfaces formed on the bases and heads of the wing rails as well as the webs of these rails. With this configuration, the frog casting is supported upon the fishing surfaces of the rail bases along the entire length of the casting. Loads borne by the tread surfaces of the casting are transmitted downwardly through the vertical side walls of the casting into the rail bases. Because the rail flanges support the frog casting, the cyclical loading caused by successive rail car wheels causes a grating action between the mating surfaces of the bottom of the frog casting and the fishing surfaces on the wing rail bases. This action causes both surfaces to abrade which ultimately results in the frog assembly becoming loose. Additionally, a portion of the vertical load on the frog casting imposed on the fishing surfaces of the rail bases results in opposed lateral forces acting to bias the wing rails apart. These forces impose a tensile loading on the bolts which clamp the rails to the frog casting. The cyclical tensile loading may result in failure of the bolt assembly which as a minimum forces replacement of the bolt assembly and may cause failure of the entire frog assembly. Grating action between the base of the frog casting and the wing rail fishing surfaces and the imposition of tensile forces on the bolts clamping the rails to the casting are avoided in Applicant's direct support railbound frog. The reason for this resides in the fact that in Applicant's frog the frog casting is not supported by the wing rails. Instead, in Applicant's frog the frog casting is supported on a rail plate or any other rail support surface. This is evidenced by the fact that the base of applicant's frog casting is spaced from the bases of the wing rails.

In a representative direct support frog assembly manufactured in accordance with the present invention the individual tie plates (58) utilized to support the assembly at spaced-apart positions throughout the length of the assembly are typically approximately 8 inches wide and are located on approximately 19½ inch centers if wooden track ties are utilized or approximately 24 inch centers if the ties are made of concrete. The direct contact which occurs between each frog casting position pad (84 or 86) at its bottom angled surfaces (134) and the wing rail fishing surfaces (104 and 124) is along a relatively narrow band usually only approximately 4 inches in length. Typically the total of such position pad contact areas in a representative direct support frog assembly (10) is less than approximately 5% of the total frog casting bottom surface areas (56) which directly transmit wheel loads into the cooperating tie or base plates and thereby approximately only 2% of the wheel loadings imposed on the novel frog assembly (10) are transmitted into the wing rails with the remaining approximately 98% being transmitted to the co-operating tie plates in by-pass relation to the wing rails. Such results in a substantial reduction of wing rail wear and damage over a given period of frog assembly usage.

Figure 5:
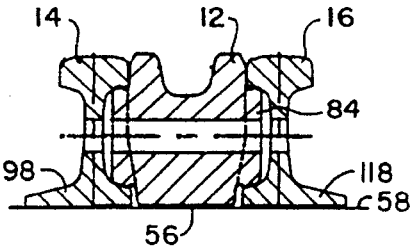
FIG. 5 is a view along line 5—5 of FIG. 2 at the toe of the casting.
Figure 6:
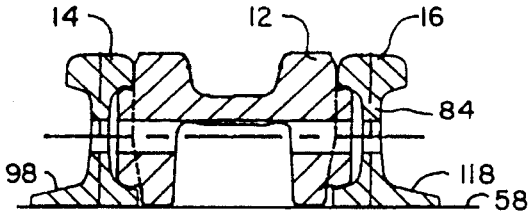
FIG. 6 is a view along line 6—6 of FIG. 2 at the throat of the casting.
Figure 9:
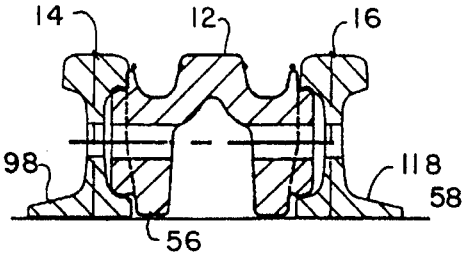
FIG. 9 is a view along line 9—9 of FIG. 2 through the point of the casting.
Figure 10:
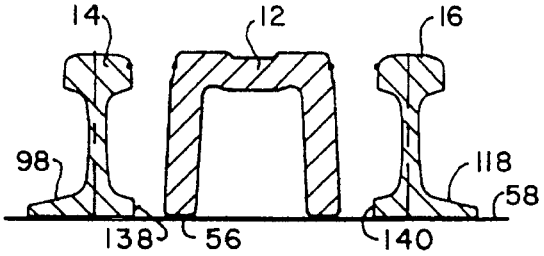
FIG. 10 is a view along line 10—10 of FIG. 2 at the heel of the casting.

FIGS. 5, 6 and 9 are cross-sectional views through the toe end (18) of Applicant's frog casting. Each of these sections show the positioning pads (84) cooperating with the adjacent wing rails (14 and 16). In each of these views it may be seen that the base (56) of the frog casting (12) is spaced from the bases (98 and 118) of the wing rails (14 and 16) such that it rests directly on the rail plate (58). Additionally, the positioning pads (84) engage only the fishing surfaces formed on the rails (14 and 16). Also, it should be noted that the vertical side walls (76 and 82) of the frog casting (12) are positioned immediately below the load bearing surfaces of the casting and extend directly to the rail plate.

Figure 7:
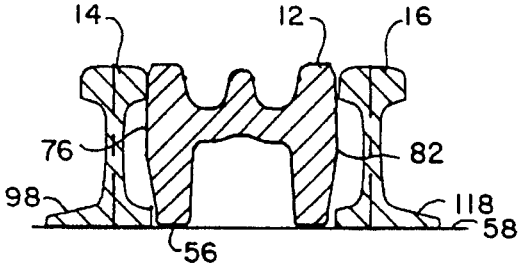
FIG. 7 is a view along line 7—7 of FIG. 2 at the point of the casting.
Figure 8:
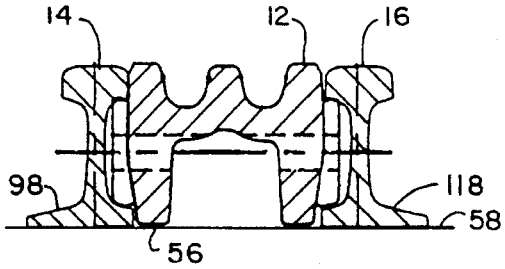
FIG. 8 is a view along line 8—8 of FIG. 2 through the point of the casting.
Figure 11:
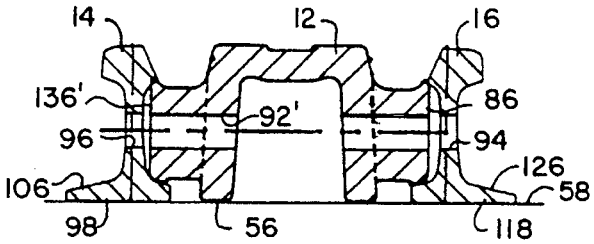
FIG. 11 is a view along line 11—11 of FIG. 2 at the heel of the casting.

FIGS. 7 and 8 are cross-sectional views of the toe end (18) of the frog casting (12) through sections which do not have positioning pads (84). Again, these views show the casting (12) touching only a single point or surface on the heads of the wing rails (14 and 16) and the bottom surface (56) spaced from the wing rail bases (98 and 118). Clearly, frog casting (12) is not supported in any manner by the wing rails (14 and 16). Views (10 and 11) are of the heel end (24) of the frog casting (12). At the heel end (24) of the casting the positioning pads are identified by the numeral (86). The elements of these pads identical to the elements of the position pads (84) at the toe end (18) of the casting are identified by identical primed numbers. These views also show the bottom surface of frog casting (56) spaced from the bases (98 and 118) of wing rails (14 and 16). Additionally, FIG. 11 shows the outer side wall (136') of the positioning pad (86) spaced from the webs (102 and 122) of these rails.

Turning again to FIGS. 4 through 11 it may be observed that there are no horizontal bottom walls forming internal passages in frog casting (12). No horizontal bottom walls are required in this casting because the side walls (76 and 82) of the casting are substantially aligned with the running surfaces (28 and 42) thereof. This construction provides adequate strength to the casting without having to resort to the added complexity of a horizontal bottom wall and internal cavities. As a result, all internal cores and the gas porosity problems associated with such cores are eliminated. It may be observed that the side wall thicknesses of the casting (12) are constant and have minimal surface contour. This results in improved castability. The frog (10) of this invention requires minimal machining which is of particular importance when working on a casting made of manganese steel. All machined surfaces are flat; either parallel to the machine table or flat at an angle. No compound flat or contoured surfaces are utilized. This substantially reduces the amount of machining required for the casting.

Since certain changes may be made in the above-described system and apparatus without departing from the scope of the invention herein and above, it is intended that all matter contained in the description or shown in the accompanying drawings shall be interpreted as illustrative and not in a limiting sense.

I claim my invention as follows:

1. A frog assembly mounted on a base plate and having a fixed wing, longitudinally extending railroad frog casting and securely clamped between a pair of wing rails at the intersection of a mainline rail and a turnout line rail comprising:

said railroad frog casting having a planar, longitudinally-extending bottom support surface; a heel end; a heel extension adapted to be attached to a pair of heel rails; a frog point integral with said heel end defined in part by said bottom surface, a pair of diverging side surfaces and a top surface which defines a mainline running surface and a turnout line running surface for railroad car wheels; and a toe end having a first wing and a second wing each defined in part by said bottom surface, an outer longitudinally extending perimeter side wall and a top wheel running surface;

wherein said first and second wings lie on opposite sides of and extend forwardly of said frog point and extend parallel to and are spaced laterally from one of said diverging side surfaces of said point to define a flangeway groove therebetween;

said first wing rail having a base with a bottom surface which rests on said base plate and a pair of opposed inclined fishing surfaces connected by a web to a head having a mainline wheel running top surface and a pair of opposed inclined fishing surfaces and said second wing rail having a base with a bottom surface which rests on said base plate and a pair of opposed inclined fishing surfaces connected by a web to a head having a turnout line wheel running top surface and a pair of opposed inclined fishing surfaces;

said first wing rail having a first wing receiving section which complements and extends parallel to said perimeter side wall of said first wing and receives said first wing and a first guard rail section and said second wing rail having a second wing receiving section which complements and extends parallel to said perimeter side wall of said second wing and receives said second wing and a second guard rail section;

wherein the top wheel running surfaces of said first and second wings are parallel to said mainline and said turnout line wheel running surfaces of said wing rails and said bottoms of said first and second wings are parallel to the bottom surface of said first and second wing rails;

wherein said railroad frog casting is freestanding such that substantially the entire bottom surface of said casting is spaced from and interposed between the base of each of said wing rails such that said entire bottom surface of said casting rests upon said rail plate;

aligned bores formed in said first and second wing rails and said railroad frog casting;

a bolt assembly having a smaller diameter than said aligned bores mounted in said aligned bores to clamp said railroad frog casting between said first and second wing rails; and wherein said bolt assembly is sized sufficiently smaller than said aligned bores to allow limited vertical movement of said railroad frog casting with respect to said first and second wing rails to ensure that any wheel loads imposed on said frog casting are transmitted to said base plate and are not taken by said bolt assembly.

2. The frog assembly of claim 1 further comprising a plurality of spaced laterally extending rail positioning pads attached to the perimeter side walls of said first and second wings and said rail positioning pads having relatively short, narrow band contact surfaces which engage a small portion of said head and base fishing surfaces of said wing rails solely to align said casting with said wing rails and said narrow band contact surfaces being spaced from said webs of said wing rails.

3. The frog assembly of claim 2 wherein said heel end is defined in part by a pair of vertical side surfaces and a plurality of spaced laterally extending rail positioning pads are attached to said vertical side surfaces and wherein said rail positioning pads having relatively short, narrow band contact surfaces which engage a small portion of said head and base fishing surfaces of said wing rails solely to align said casting with said wing rails and said narrow band contact surfaces being spaced from said webs of said wing rails.

4. The frog assembly of claim 1 wherein the outer edges of said bottom support surface of said frog casting are interposed between and extend parallel to the bases of said wing rails.

5. The frog assembly of claim 1 wherein said bottom surface of said casting is spaced from the base of each of said wing rails.

6. The frog assembly of claim 4 wherein the bases of said first and second wing rails are cut adjacent to said bottom support surface of said frog casting to thereby enable said bottom support surface of said frog casting to be positioned laterally outwardly such that said bottom support surface is located substantially beneath said mainline and said turnout line running surfaces on said casting.

7. The frog assembly of claim 3 wherein said perimeter side walls of said first and second wings and said vertical side surfaces of said heel have a substantially uniform thickness and shape from one end of said casting to the other to aid uniform solidification of said casting.

8. The frog assembly of claim 2 wherein each of said rail positioning pads defines a through lateral bore.

9. The frog assembly of claim 3 wherein each of said rail positioning pads defines a through lateral bore.

10. The frog assembly of claim 4 wherein said outer edges of said bottom support surface of said frog casting are spaced from the bases of said wing rails.

* * * * *